US010914455B2

(12) United States Patent
Tepo et al.

(10) Patent No.: US 10,914,455 B2
(45) Date of Patent: Feb. 9, 2021

(54) LIGHT FIXTURE HAVING FLEXIBLE SHROUD

(71) Applicant: ABL IP Holding LLC, Atlanta, GA (US)

(72) Inventors: Megan Marie Tepo, Lakewood, CO (US); Douglas Dewayne Grove, Grayson, GA (US); Daniel Aaron Weiss, Tucker, GA (US); Januk Swarup Aggarwal, Alexandria, VA (US)

(73) Assignee: ABL IP Holding LLC, Atlanta, GA (US)

( * ) Notice: Subject to any disclaimer, the term of this patent is extended or adjusted under 35 U.S.C. 154(b) by 105 days.

(21) Appl. No.: 16/394,371

(22) Filed: Apr. 25, 2019

(65) Prior Publication Data

US 2019/0331321 A1 Oct. 31, 2019

Related U.S. Application Data

(60) Provisional application No. 62/662,419, filed on Apr. 25, 2018.

(51) Int. Cl.

| | |
|---|---|
| ***F21V 15/01*** | (2006.01) |
| ***F21S 8/02*** | (2006.01) |
| ***F21V 15/015*** | (2006.01) |
| ***F21V 21/14*** | (2006.01) |

(52) U.S. Cl.

CPC ..... *F21V 15/012* (2013.01); *F21S 8/026* (2013.01); *F21V 15/015* (2013.01); *F21V 21/14* (2013.01)

(58) Field of Classification Search

CPC ..... F21V 15/012; F21V 15/015; F21V 21/14; F21S 8/026

See application file for complete search history.

(56) References Cited

U.S. PATENT DOCUMENTS

| | | | | |
|---|---|---|---|---|
| 2,998,511 | A | 8/1961 | Chan | |
| 4,475,147 | A | 10/1984 | Kristofek | |
| 4,729,080 | A | 3/1988 | Fremont et al. | |
| 4,930,054 | A | 5/1990 | Krebs | |
| 5,921,655 | A | 7/1999 | Nassim | |
| 6,095,669 | A | 8/2000 | Cho | |
| 7,014,341 | B2 | 3/2006 | King et al. | |
| 7,969,321 | B2 | 6/2011 | Spellman | |
| 8,177,396 | B2 | 5/2012 | Gordin | |
| 2008/0002411 | A1 | 1/2008 | King et al. | |
| 2014/0301092 | A1* | 10/2014 | Wronski | F21V 23/00 362/418 |

* cited by examiner

*Primary Examiner* — Mary Ellen Bowman

(74) *Attorney, Agent, or Firm* — Kilpatrick Townsend & Stockton LLP

(57) ABSTRACT

A light fixture includes a flexible shroud, an outer housing, and a light source within a light engine. The light engine couples within the outer housing so as to define a gap between the light engine and an inner perimeter of the outer housing. The flexible shroud forms at least first and second edge portions. The light engine couples with the first edge portion, and the inner perimeter of the outer housing couples with the second edge portion, so that the flexible shroud covers at least part of the gap. A shroud for a light fixture may include a flexible shroud that defines one or more edges. The shroud may include one or more coupling features along the one or more edges. The flexible shroud may form a thickness variation at the coupling feature, to engage a corresponding coupling feature of a light fixture.

20 Claims, 10 Drawing Sheets

FIG. 2A
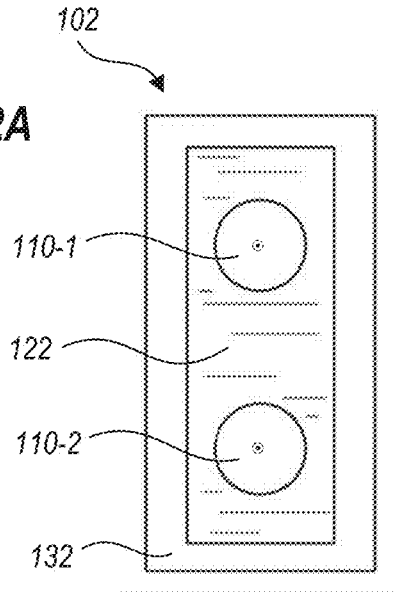
FIG. 2B
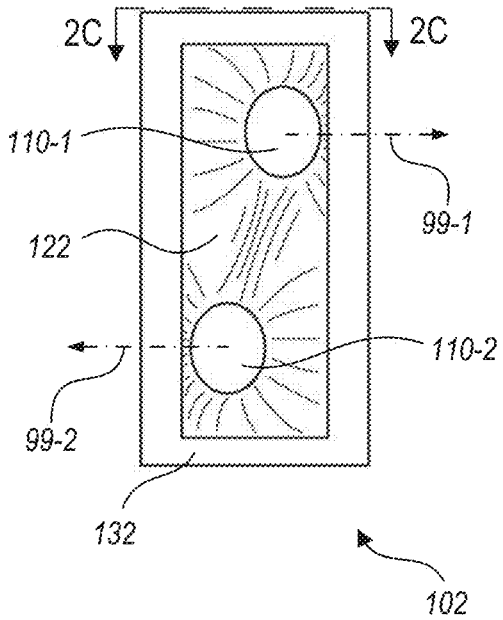
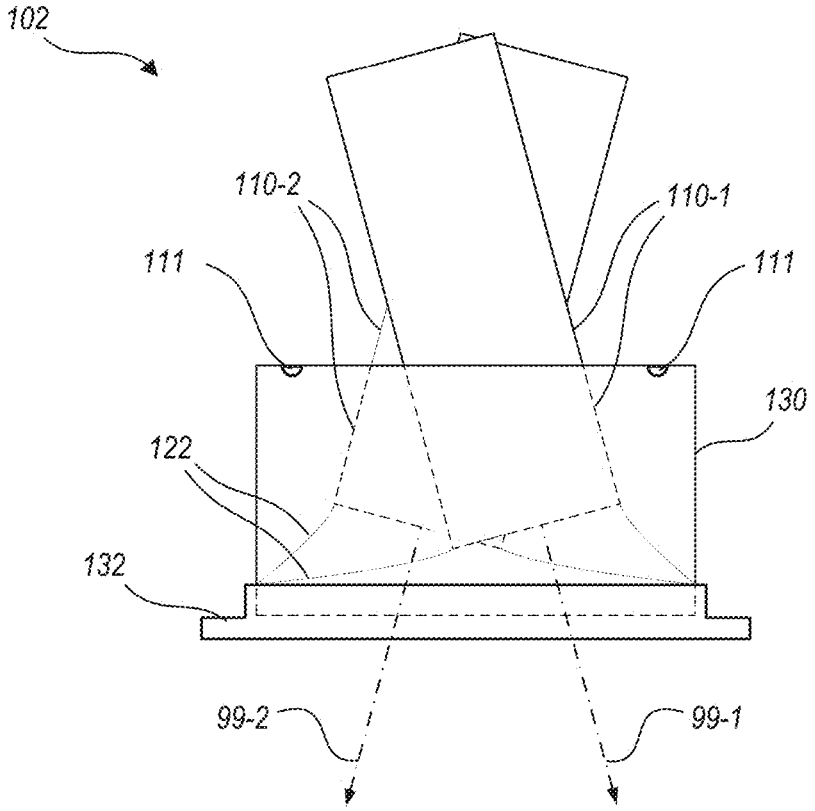
FIG. 2C

FIG. 3A
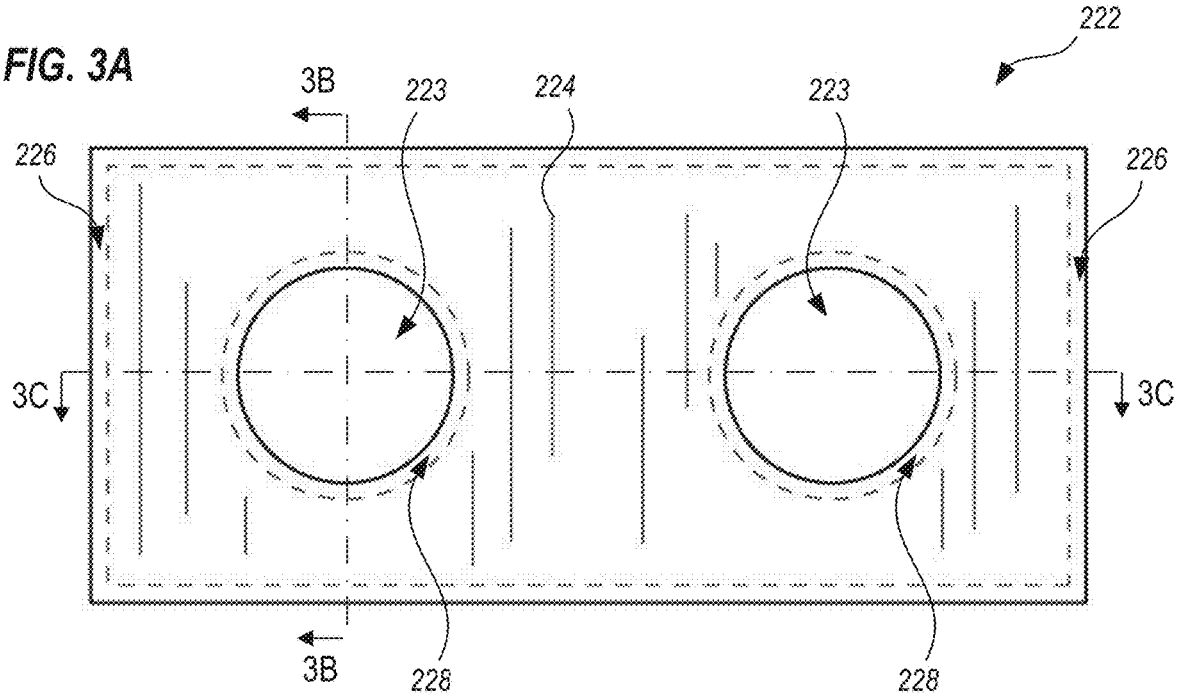
FIG. 3B
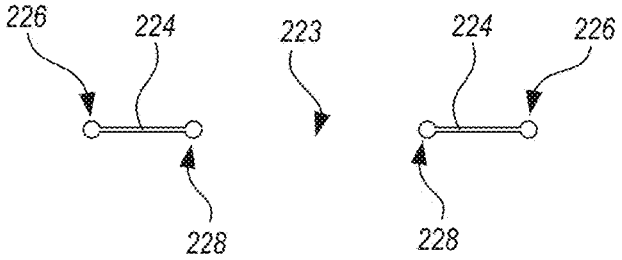
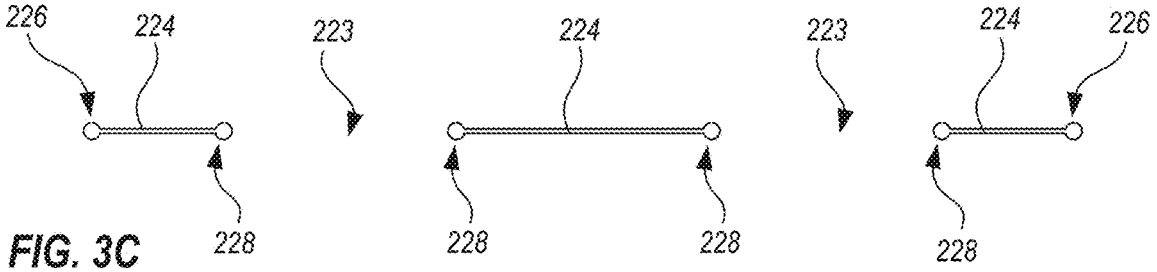
FIG. 3C

LIGHT FIXTURE HAVING FLEXIBLE SHROUD

CROSS REFERENCE TO RELATED APPLICATIONS

This application claims the benefit of priority to U.S. Provisional Patent Application Ser. No. 62/662,419, entitled "Light Fixture Having Flexible Membrane," which was filed on 25 Apr. 2018 and is incorporated herein in its entirety for all purposes.

BACKGROUND

Light fixtures for interior lighting are often designed with the objective of providing high quality illumination, and adjustability to provide the illumination at certain angles relative to a ceiling or wall surface that the light fixture is mounted in. Another design objective can be to provide the illumination without necessarily drawing visual attention to the light fixture that provides it. These objectives are sometimes at cross purposes. For example, mechanical adjustability of a light fixture can lead to creation of a space or gap between a fixed, outer portion of the light fixture (e.g., that may be mounted to the ceiling or wall surface) and a movable portion (e.g., a light engine) that allows the illumination to be pointed toward a specific direction. The gap can be a distracting visual element, as can components of the light fixture that may be visible through the gap.

SUMMARY

Quiet-ceiling light fixture systems and methods herein recognize the advantages of providing a visually "quiet" light fixture, that is, one which has minimal distracting visual structure, for example between a fixed outer housing and an adjustable light engine within the housing.

In an embodiment, a light fixture includes a light source coupled within a light engine. The light fixture also includes an outer housing and a flexible shroud. The outer housing forms an inner perimeter. The light engine couples within the outer housing so as to define a gap between the light engine and the inner perimeter of the outer housing. The flexible shroud forms at least first and second edge portions. The light engine couples with the flexible shroud along at least a portion of the first edge portion, and the inner perimeter of the outer housing couples with the flexible shroud along the second edge portion, so that the flexible shroud extends across at least a portion of the gap.

In an embodiment, a shroud for a light fixture includes a flexible shroud that defines one or more edges. The shroud includes one or more coupling features along the one or more edges. The flexible shroud forms a thickness variation at the coupling feature, to engage a corresponding coupling feature of a light fixture.

In an embodiment, a method of visually de-emphasizing a gap between a light engine and a light fixture housing includes providing a light fixture housing that has an output aperture bounded by an inner perimeter, providing a light source within a light engine, and coupling the light engine within the light fixture housing. The light engine is coupled and disposed within the light fixture housing so as to leave a gap between the light engine and the inner perimeter of the light fixture housing. The light engine is configured to emit light through the output aperture. The method also includes coupling a flexible shroud across at least a portion of the gap between the light engine and the inner perimeter of the housing. The flexible shroud obscures a substantial portion of the gap.

BRIEF DESCRIPTION OF THE DRAWINGS

Embodiments are described in detail below with reference to the following figures, in which like numerals within the drawings and mentioned herein represent substantially identical structural elements. It is noted that, for purposes of illustrative clarity, certain elements in the drawings may not be drawn to scale. Specific instances of an item may be referred to by use of a numeral followed by a dash and a second numeral (e.g., light engines 110-1, 110-2 etc.) while numerals not followed by a dash refer to any such item (e.g., light engines 110). Also, in instances where multiple instances of an item are shown, only some of the instances may be labeled, for clarity of illustration.

FIG. 2A is a bottom plan schematic view illustrating a light fixture that includes two light engines and a flexible shroud, with the light engines aimed directly downward, according to one or more embodiments.

FIG. 2B is a bottom plan schematic view illustrating the light fixture of FIG. 2A, with the light engines aimed in different directions.

FIG. 2C is a schematic end view illustrating the light fixture of FIGS. 2A and 2B.

FIGS. 3A, 3B and 3C are schematic plan, lateral cross-sectional, and axial cross-sectional views respectively that schematically illustrate a shroud that includes a flexible shroud, according to one or more embodiments.

DETAILED DESCRIPTION

Figure 1:
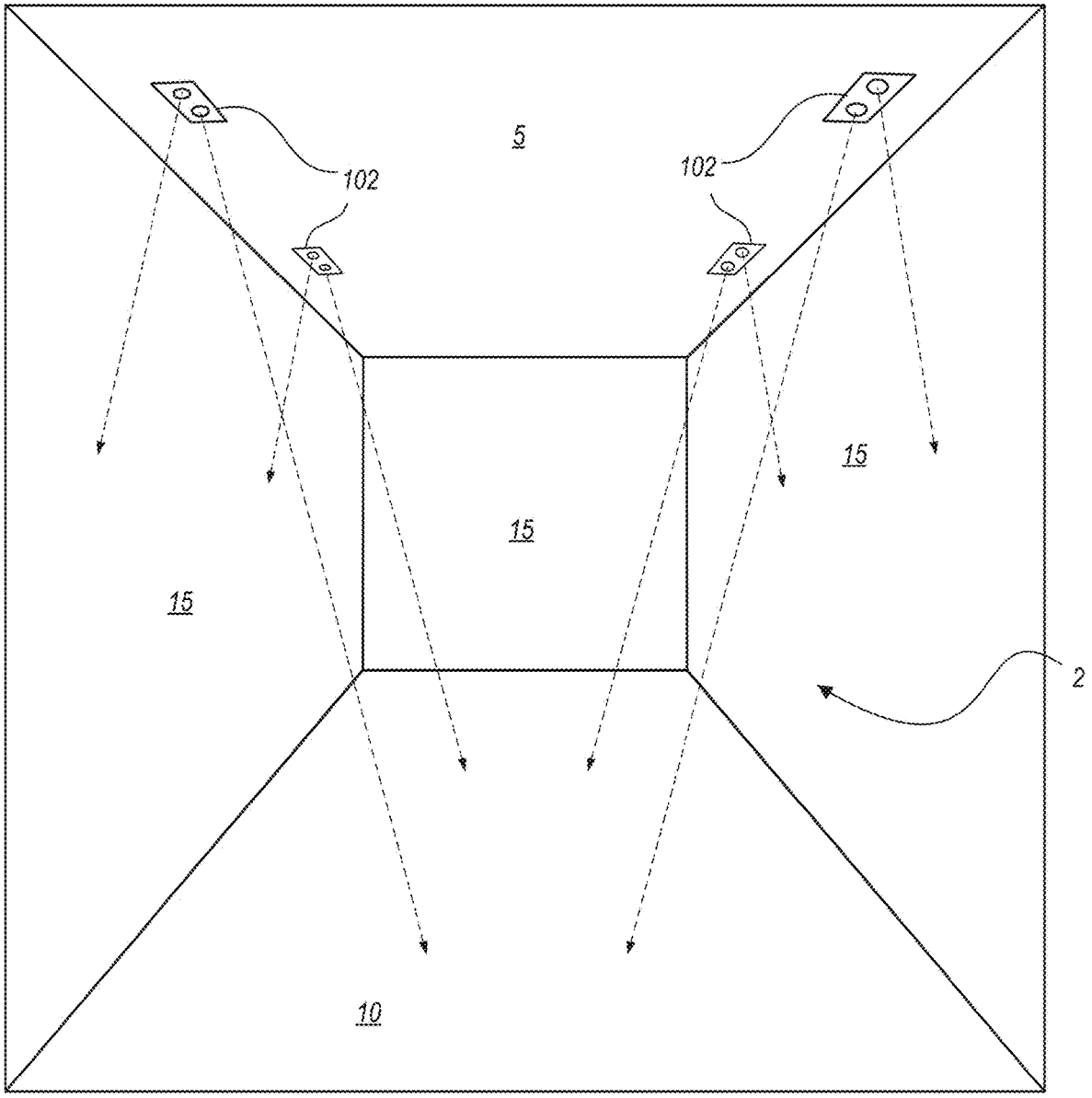
FIG. 1 is a schematic perspective view of an interior space illuminated by light fixtures with flexible shrouds, according to one or more embodiments.

The subject matter of embodiments of the present invention is described here with specificity to meet statutory requirements, but this description is not intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Each example is provided by way of illustration and/or explanation, and not as a limitation. For instance, features illustrated or described as part of one embodiment may be used on or with another embodiment to yield a further embodiment. Upon reading and comprehending the present disclosure, one of ordinary skill in the art will readily conceive many equivalents, extensions, and alternatives to the specific, disclosed light fixture types, all of which are within the scope of embodiments herein.

In the following description, positional terms like "above," "below," "vertical," "horizontal" and the like are sometimes used to aid in understanding features shown in the drawings as presented, that is, in the orientation in which labels of the drawings read normally. These meanings are adhered to, notwithstanding that light fixtures herein may be mounted to surfaces that are not horizontal.

Certain embodiments herein provide light fixtures that use flexible materials to form a shroud between an outer housing and one or more light engines. In some of these embodiments, a flexible shroud provides a visually "flat" appearance, that is, a surface that is not highly reflective, and the reflectance that exists is diffusive and insensitive to light incidence angle. Given such properties, a flexible shroud may have a uniform, dull appearance that is not very sensitive to the angle of the surface. In other embodiments, portions or all of the flexible shroud can be moderately or highly reflective, such that light is reflected, but the flexible nature of the shroud provides a smooth transition between the light engine and the outer housing. Also, in some embodiments, the flexible shroud can stretch sufficiently to cover a gap across which it is installed (e.g., a gap between the light engine and the outer housing) even when the light engine is adjusted relative to the outer housing.

Some embodiments of light fixtures provide one or more light sources, each such light source being within a corresponding light engine, and one or more of the light engines being positionally and/or rotatably adjustable. That is, the light engine may be tilted in polar angle and/or rotated in azimuthal angle within an outer housing, according to needs at a given location. Certain embodiments feature a flexible membrane that is integrally formed with thickness variations that facilitate coupling with an inner perimeter of the outer housing, and/or the light engine. In some embodiments, a flexible shroud will have an outer periphery that couples with an inner perimeter of the outer housing, and an aperture defining an inner periphery that couples with a light engine, but this is not required. For example, in certain other embodiments, a light engine may couple with an outer housing along an edge (e.g., with a hinge) and the flexible shroud may cover part or all of a gap between the light engine and the outer housing away from the edge. This eliminates the gap itself as a distracting visual feature of the light fixture. The flexible shroud can also conceal internal components of the light fixture (e.g., light aiming or tilting mechanisms) from view. Also, in certain embodiments, a flexible shroud may form more than one aperture, such that each aperture couples with a separate light engine in a light fixture that has more than one light engine. Thus, improved aesthetics are one reason to use a flexible shroud. Other reasons generally relate to using the shroud as a barrier to discourage entry of materials into the light fixture housing through the gap. For example, in embodiments a flexible shroud can prevent ingress of dirt, dust, liquids, gases, smoke, biohazardous materials, other materials, and/or flames into the light fixture. This can not only protect the light fixture itself from such materials, but can also enable the light fixture to form part of a comprehensive barrier between an illuminated space and adjacent spaces.

FIG. 1 is a schematic perspective view illustrating an interior space 2 illuminated by light fixtures 102, according to embodiments. FIGS. 2A and 2B are bottom plan schematic views illustrating light fixture 102, with light engines 110 aimed directly downward in FIG. 2A, and aimed to the right and left in FIG. 2B. FIG. 2C is a schematic end view illustrating light fixture 102, as seen from direction 2C-2C noted in FIG. 2B, and with light engines 110 aimed as in FIG. 2B.

In FIG. 1, light fixtures 102 are recessed within a ceiling 5. Each light fixture 102 is shown as including two light engines aimed in different directions shown as dashed arrows, but embodiments herein may have any number of light engines aimed in any direction(s). Ceiling 5 is used as a mounting surface for light fixtures 102, but this is not required; light fixtures herein may mount with other surfaces such as walls 15, floor 10 or any other available surface. Similarly, light fixtures 102 need not be always installed flush with a mounting surface; such light fixtures can be installed flush with, above, below, or crossing through a plane of a mounting surface, or may be supported by devices such as poles, hangers, cables and the like.

FIGS. 2A and 2B are bottom plan schematic views, and thus illustrate only those portions of light fixtures 102 that would be visible from below. As shown in FIGS. 2A and 2B, each light fixture 102 includes two light engines, 110-1 and 110-2. Each light fixture 102 shown in FIGS. 2A and 2B defines a rectangular outer perimeter, but this is not required; in other embodiments, light fixtures 102 may be of any convenient shape such as circular, ellipsoidal, ovoid, square, trapezoidal, or other shapes. Each light fixture 102 also includes a shroud 122 and a trim piece 132. Trim piece 132 may, for example, hide an inner perimeter of an outer housing of light fixture 102 (e.g., outer housing 130, FIG. 2C) and an edge of an aperture within an architectural surface (e.g., ceiling 5, FIG. 1) in which light fixture 102 is mounted. Each light engine 110 includes a light source (e.g., an LED, incandescent, halogen and/or fluorescent light source), although the scales of FIGS. 1, 2A, 2B and 2C do not enable illustration of this detail.

Referring to FIG. 1 and FIG. 2B, light engines 110 are shown within light fixtures 102, and a broken arrow 99 extends from a center of light emission for each light engine 110, illustrating a center beam path of light from the corresponding light engine 110. Broken arrows for different ones of light engines 110 are shown extending in different directions, illustrating the adjustability of light engines 110 within each light fixture 102. Light engines 110 may be fixed in position and/or orientation within light fixture 102, or may be adjustable in polar and/or azimuthal angle, either before or after installation. Shroud 122 may be formed at least in part of a flexible membrane or other flexible material, and covers a gap that would otherwise exist between light engines 110 and the outer housing of light fixture 102.

In FIG. 2A, a central circle and dot designate the light that is emitted perpendicular to the plane of the drawing. As shown, each light engine 110 forms a circular outer perimeter (but this is not required; in other embodiments, light engines 110 may be of any convenient shape). In FIG. 2B, light engines 110 are tilted and/or rotated within light fixture 102 so as to direct light emission in different directions, each such direction shown by a broken arrow 99. Flexible shroud 122 stretches and flexes to match the position of light engines 110. However, in some embodiments, the optical appearance of shroud 122 does not change substantially from a viewer's perspective. That is, from a typical viewing distance, shroud 122 may provide a flat appearance that does not reveal the surface curves introduced by the positioning of light engines 110. Instead, shroud 122 has a diffuse look in both FIGS. 2A and 2B that does not emphasize, and in some cases may not reveal at all, the shape of the flexible shroud having stretched and/or flexed due to the movement of light engines 110 in FIG. 2B, relative to their positions in FIG. 2A. The shading applied in FIG. 2B around shroud 122 is merely to illustrate that shroud 122 is in fact flexible, stretching or contracting as needed to accommodate positions of light engines 110-1 and 110-2.

FIG. 2C schematically illustrates light engines 110-1 and 110-2 as being tilted relative to an outer housing 130 of light fixture 102, so that light emits through an output aperture of light fixture 102 according to the directions of arrows 99-1 and 99-2. In FIG. 2C, portions of light engines 110 hidden within outer housing 130, and portions of outer housing 130 hidden within trim piece 132, are shown in coarse broken lines; cross-sections of shroud 122 that connect edges of light engines 110 with outer housing 130 are shown in finer broken lines. As shown, each light engine 110 forms a roughly rectangular end view that, coupled with the circular outer perimeter thereof noted in FIGS. 2A and 2B, suggests that light engines 110 are cylindrical. However, this is not required; in other embodiments, light engines 110 may be of any convenient shape. FIG. 2C also illustrates a case in which output apertures of light engines 110 are recessed within outer housing 130 and above trim piece 132. Other relative heights of light engines 110 with respect to outer housings and/or trim pieces are also possible (e.g., see FIGS. 11, 12).

FIG. 2C also illustrates light sources 111 within outer housing 130, showing how light sources 111 adjoin and extend above flexible shroud 122. In certain embodiments, a shroud 122 may be translucent, and may be backlit by one or more light sources 111 within light fixture 102 such that the flexible membrane itself glows. In these embodiments, the flexible membrane is advantageously translucent enough to allow a substantial portion of light from light sources 111 through, yet provides enough diffusion (either because of its bulk material properties or its surface finish or texture) to provide a uniform glow. That is, the diffusive characteristics spread out the backlighting so that light sources 111 are not visually identifiable from beneath. Any number or positioning of light sources 111 may be utilized. FIGS. 3A, 3B and 3C are schematic plan, lateral cross-sectional, and axial cross-sectional views respectively that schematically illustrate a flexible shroud 222 that includes a flexible membrane 224. For clarity of illustration, shroud 222 is depicted as consistent with shroud 122, FIGS. 2A, 2B, but shrouds having flexible membranes may take many other forms; the features of shroud 222 are shown to illustrate exemplary features rather than to limit the present disclosure to the features and shapes shown.

Shroud 222 is an example of one type of flexible shroud that is based on a membrane, which can be formed by molding and can thus be monolithically integrated with thickness variations and/or other features to provide advantages such as to facilitate assembly, locally adjust optical performance, improve reliability, and others. (Other flexible materials may also be used to form a flexible shroud; see for example FIG. 4). Shroud 222 includes flexible membrane 224, which forms apertures 223 therethrough. Flexible membrane 224 also forms optional thickness variations 226 at a first edge that forms an outer periphery of membrane 224, and forms optional thickness variations 228 at second edges that form inner peripheries of membrane 224; that is, adjacent to each aperture 223. Optional thickness variations 226 and 228 may be, for example, rimlike features that are integrally molded with flexible membrane 224, and can provide convenient features for an outer housing, or light engines, to couple with. In certain embodiments, either or both of an outer housing or light engines include coupling features that clamp about thickness variations 226 or 228. Although thickness variations 226 and 228 are shown as roughly circular, rimlike portions that extend above and below flexible membrane 224 in FIGS. 3B and 3C, this is not required; thickness variations 226 and 228 may extend more to one side of flexible membrane 224 than to the other side, and may be of different shapes and locations. For example, in some embodiments, thickness variations 226 and 228 do not extend about entire inner and outer peripheries of flexible membrane 224, but are located intermittently thereabout. In some of these, and in other embodiments, thickness variations may also be provided in locations other that edges and for other reasons, for example to make flexible membrane 224 more rigid in certain locations and/or directions than others, or to locally alter optical properties of flexible membrane 224. At least a portion of flexible membrane 224 is typically visible in a light fixture in which shroud 222 is installed, while thickness variations 226 and 228 may or may not be visible.

In other embodiments, shroud 222 does not include thickness variations 226 and/or 228. For example, shroud 222 may be held in place by clamping it between inner and outer frames (e.g., a mechanism resembling an embroidery hoop or frame). In these embodiments, shroud 222 can simply be cut from a sheet of flexible material, for example by die cutting, punching, stamping, laser cutting or the like.

As installed, flexible membrane 224 of shroud 222 may be in tension across at least part of a gap between a light engine and an inner perimeter of a light fixture, and may couple movably with respect to either of the light engine and an inner perimeter of the light fixture so as to minimize this tension. For example, flexible membrane 224 may be stretched across a gap between one or more light engines and the inner perimeter of the light fixture, as it couples with both. Alternatively, flexible membrane 224 may be coupled with the light engine and the light fixture before the light engine is moved into a final position within the light fixture, such that moving the light engine into its final position stretches flexible membrane 224.

Shroud 222 may also couple movably with respect to either or both of the light engine(s) and the light fixture. In particular, when either of the light engine and the light fixture is circular, shroud 222 may couple rotatably with respect to the circular feature. This advantageously allows shroud 222 to slip about the perimeter of the circular feature so as to minimize the tension on flexible membrane 224, which helps avoid the tendency for membrane 224 to wrinkle or fold in response to twisting between the light engine and the light fixture. A movable coupling of this type may be formed directly between shroud 222 and the corresponding circular feature (e.g., shroud 222 slips within a clamping type feature) or the circular feature may include a rim that clamps fixedly with shroud 222, but slips with respect to other portions of the circular feature (e.g., a movable rim on the circular feature may be held to the circular feature, but the rim can rotate about the circle, such a rim is sometimes called a slip ring).

Mechanical material properties that are useful for shroud 222 generally include flexibility, elasticity, resistance to hardening, resistance to thermal degradation, resistance to flammability, moldability, and ability to be formed with a smooth or diffusive finish (e.g., surfaces that do, or do not, form specular reflections). However, certain applications utilize materials that are initially flexible and/or elastic, but can be dried, cured or otherwise hardened to retain a particular shape. Certain applications may also benefit from chemical resistance and/or an ability to hold a surface finish such as paint or metallization. Optical properties that are useful for shroud 222 include opacity or translucency as desired for a specific application, appearing visually "flat" (e.g., having little change in reflectance as a function of viewing angle) and resistance to optical effects of aging or exposure, such as clouding, hazing and/or yellowing.

Shroud 222 may be a monolithically formed material (e.g., molded or cast) or may be formed of a flexible material with other materials used for reinforcement. For example, in embodiments a flexible shroud may have edge features that are molded around reinforcing materials, held around reinforcing materials with adhesives, fasteners, sewn together or the like. These and/or other embodiments may also have molded thickness variations for increased durability and/or rigidity in specific areas. Material choices for monolithic shrouds 222 include, for example, certain silicones, rubbers or plastics. Other materials that may be used for at least the flexible membrane portion of shrouds 222 include flexible or stretchable polymer-based fabrics such as nylon, spandex, lycra, elastane and the like. For some embodiments, many stretchable fabrics are advantageously formed of fine threads oriented in many directions such that light reflected from the fabrics do not vary significantly as a function of angle, enhancing the visually "flat" appearance. Materials that affect light reflectance or transmittance, such as phosphors, pigments, dyes or dichroic materials, may optionally be admixed or co-molded with a base material or fabric to form shroud 222 or portions thereof. In certain embodiments, metallic fabrics may be used, while in other embodiments, shroud 222 may be formed of an elastic, non-woven material with part or all of its area provided with a metalized surface.

Flexible membrane 224 is typically between one and five millimeters thick, except at thickness variations such as 226, 228 described above, which may be of any convenient dimension. In embodiments, flexible membrane 224 forms a thickness of three millimeters or less at any point that is at least three millimeters away from thickness variations 226 and/or 228. However, these thicknesses are not required, and specific applications may have thinner or thicker flexible membranes. Also, flexible membrane 224 may vary in thickness from one location to another, so as to provide variations in stiffness, flexibility, strength and/or opacity as required for a specific application. Flexible membrane 224 may be formed such that its native shape (e.g., without any forces applied) is flat, or it may be formed with initial contours or curves matching features or component positions of an intended light fixture, so that membrane 224 need not be stretched during installation or to hold an initial position. For example, flexible membrane 224 may be downwardly concave with no forces applied thereto, for use with a light fixture wherein light engines are recessed with respect to an output aperture of the light fixture.

Figure 4:
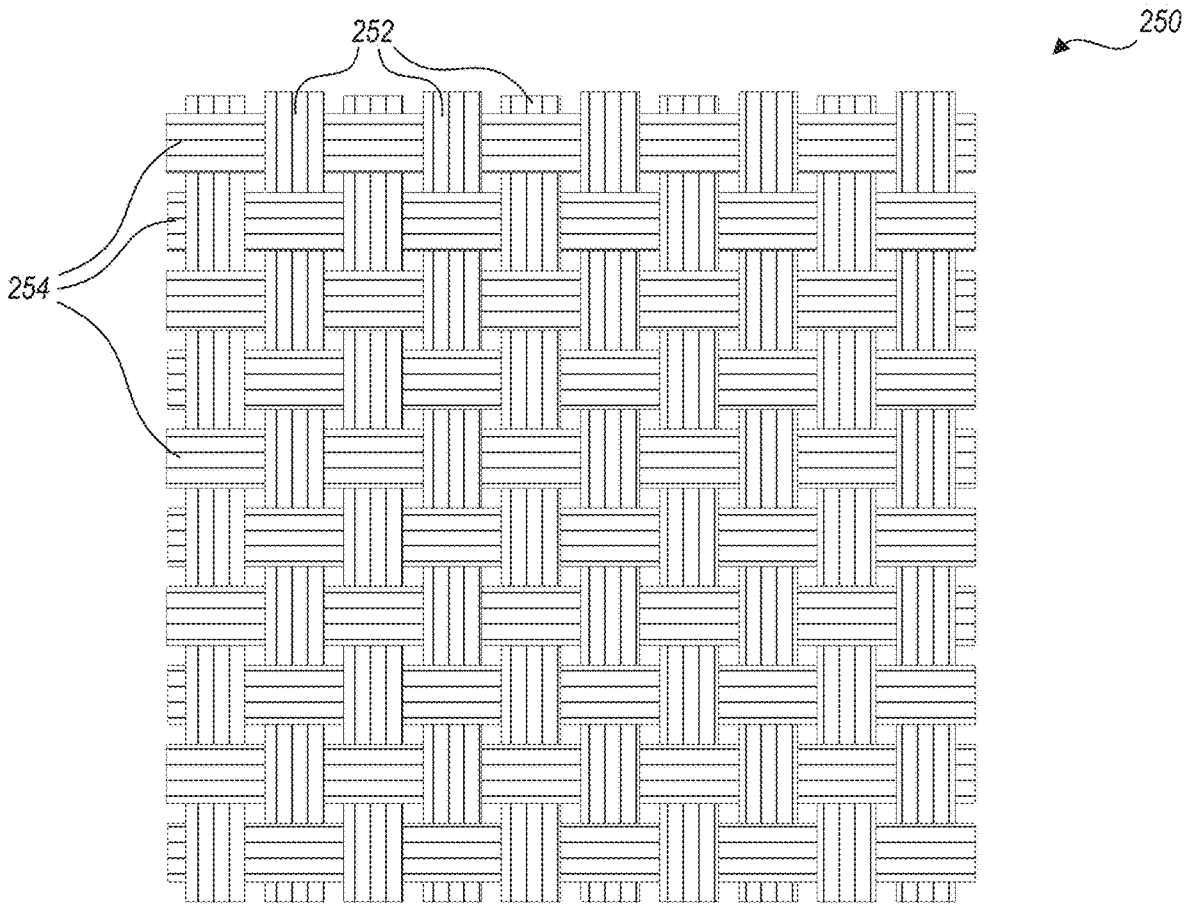
FIG. 4 is a schematic illustration of a portion of a flexible fabric that may be used as at least part of a flexible shroud, according to one or more embodiments.

FIG. 4 is a schematic illustration of an exemplary portion 250 of a flexible fabric that may be used as at least part of a flexible shroud. Exemplary portion 250 is formed of alternating first fibers 252 and second fibers 254, although other fabrics suitable for use as a flexible shroud may be formed of a single fiber or more than two fibers. Also, fibers 252 and 254 are each shown in FIG. 4 as laid out such that adjacent ones of the fibers do not touch one another, but this is not critical, and layouts can be adjusted to produce fabrics with desired characteristics. Portion 250 is shown to illustrate that fabrics can be formed of known materials and in known ways to provide certain of the properties noted above (e.g., flexibility, elasticity, resistance to hardening or thermal degradation, and optical surface finish qualities). For example, fibers 252 and/or 254 can be formed of materials that are elastic, or non-elastic fibers chosen for a specific surface finish (e.g., metal or metallized fibers) can be woven so that the fabric formed is elastic nonetheless. Also, fibers 252 and/or 254 (and/or additional fibers) can be selected and/or woven to provide different properties along different directions, such as a fabric that is more elastic in one direction than another. One of ordinary skill in the art will readily conceive many equivalents, extensions, and alternatives to the specific, disclosed fiber and/or fabric types.

Figure 5:
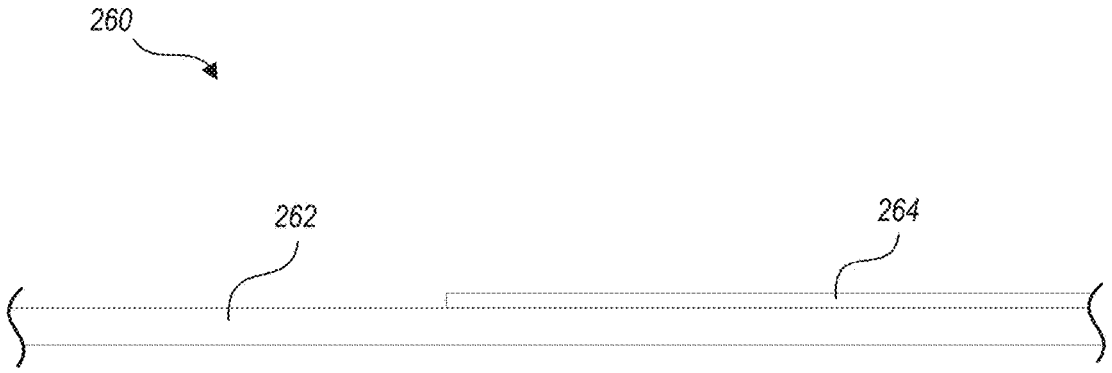
FIG. 5 is a schematic diagram of a portion of a flexible shroud formed of a base material, and a second material associated with a subportion of the base material, according to one or more embodiments.

FIG. 5 is a schematic diagram of a portion 260 of a flexible shroud formed of a base material 262 and a second material 264 associated with a subportion of base material 262. Base material 262 is a flexible material otherwise suitable for forming a flexible shroud as discussed herein, and second material 264 may be utilized to locally modify optical and/or mechanical properties of base material 262. For example, base material 262 may be a membrane or a fabric, both of which are discussed above. Second material 264 may be, without limitation, a material that alters opacity, reflectivity, elasticity, chemical resistance, flammability resistance, or the like. Second material 264 may be a material that forms a distinct layer atop base material 262, or that reacts or intermingles with material of base material 262. Second material 264 can be formed over all of base material 262, or may be formed in selected subportions only, by techniques such as screen printing, evaporation, sputtering, painting, comolding, embroidery, milling or the like.

Figure 6:
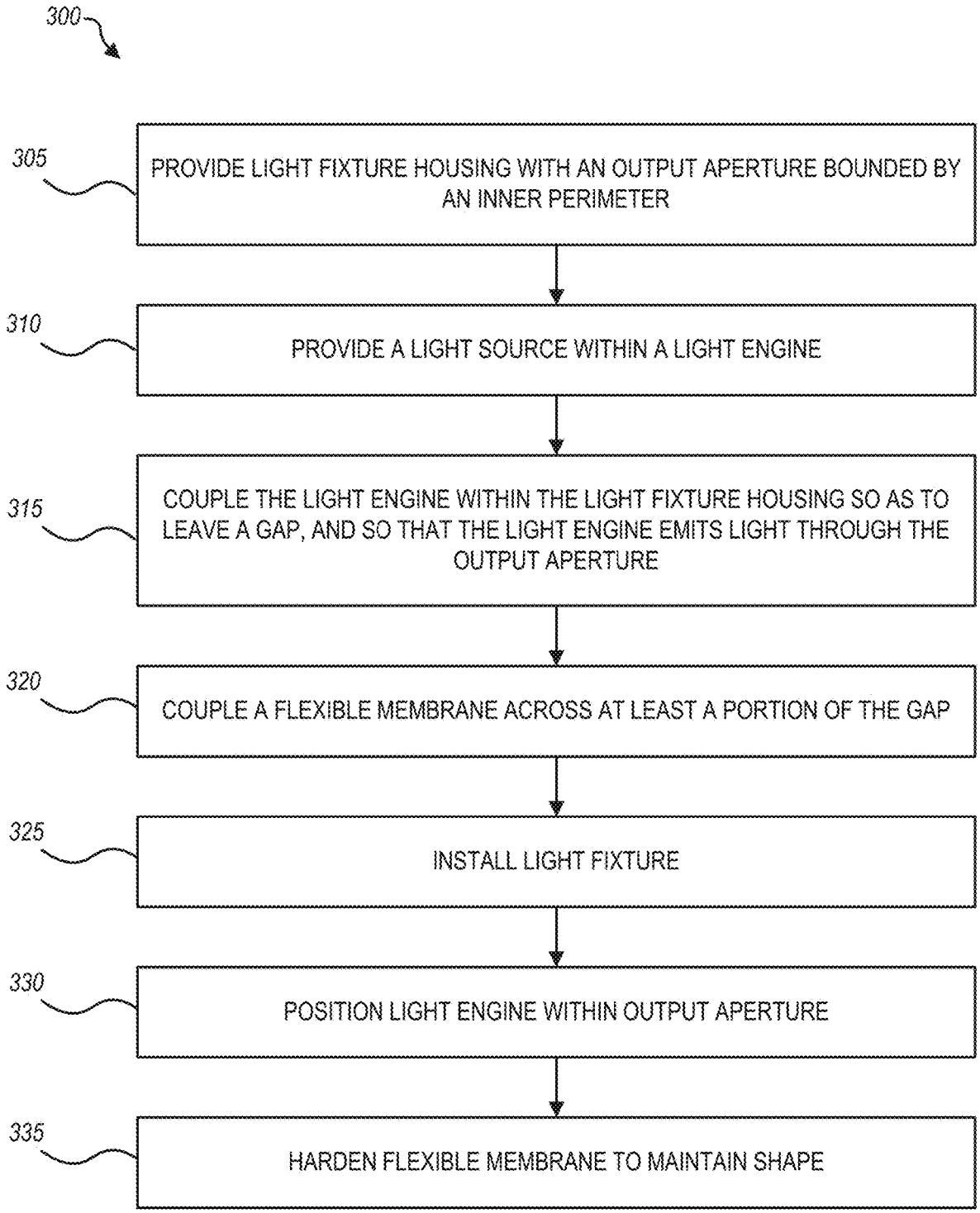
FIG. 6 is a flowchart that illustrates a method of de-emphasizing a gap between a light engine and a light fixture housing, according to one or more embodiments.

FIG. 6 is a flowchart illustrating steps of a method 300 for de-emphasizing a gap between a light engine and a light fixture housing. Certain steps of method 300 relate to manufacturing a light fixture, while other steps relate to installing a light fixture, and/or fixing a shape of a flexible shroud of a light fixture. It should be understood that depiction of the steps of method 300 as a group, and in a particular order, do not mean that all such steps must be performed, or that any such steps must be performed in the order shown. Upon reading and comprehending FIG. 6 and the following discussion, one of ordinary skill in the art will readily conceive many equivalents, extensions, and alternatives.

Step 305 of method 300 provides a light fixture housing with an output aperture that is bounded by an inner perimeter. An example of step 305 is providing a housing of light fixture 102, FIGS. 2A, 2B, 2C, including trim piece 132 that provides an output aperture bounded by an inner perimeter of trim piece 132. Step 310 provides a light source within a light engine. An example of step 310 is obtaining or manufacturing a light engine 110, FIGS. 2A, 2B, 2C, with light sources such as LEDs (or incandescent, halogen, or fluorescent sources) therein that can provide light. Step 315 couples the light engine within the light fixture housing so as to leave a gap, and so that the light engine emits light through the output aperture. An example of step 315 is coupling a light engine of a light engine 110, FIGS. 2A, 2B, 2C, within the light fixture housing that includes trim piece 132. The light engine 110 is coupled within the light fixture housing oriented so that light from light engine 110 emits through the output aperture defined by trim piece 132.

Step 320 of method 300 couples a flexible shroud across at least a portion of the gap. An example of step 320 is coupling shroud 122 or 222 with light engines 110 and the housing of light fixture 102, such that flexible membrane 224, FIGS. 3A, 3B, 3C, extends across at least part of gaps formed between light engines 110 and the housing of light fixture 102. The flexible shroud can have any of the attributes discussed above, and can be formed by any of the techniques discussed above.

Steps 305 through 320 can be performed in various orders and at various locations. For example, steps 305 through 320 can all be performed at the point of manufacturing so that a light fixture with a light engine and a flexible shroud is the end product delivered. Alternatively, light fixture components can be provided in kit form to installers who can select one or more appropriate housings, light sources, light engines and flexible shrouds at the point of installation, and integrate such components on site.

Step 325 installs a light fixture at an installation site. In certain embodiments, the installed light fixture includes all of the components noted in steps 305 through 325, but subsets of such components may be installed. An example of step 325 is installing light fixture 102 within ceiling 5, FIG. 1. Of course, a light fixture herein may also be installed in surfaces that are not ceilings, such as walls 15, FIG. 1. Step 330 positions the light engine within an output aperture of a light fixture. An example of step 330 is tilting or swiveling a light engine 110 to adjust a direction of emitted light, such as illustrated by comparing FIG. 2A (with light emitting out of the page) with FIG. 2B (with light emitting in the direction of arrows). As noted above, a flexible membrane of the light fixture will yield to provide a smooth transition between light engines and a housing of the light fixture.

An optional step 335 hardens a flexible shroud so that the shroud retains its shape. This might be useful in fixed luminaires for which multiple versions have different but fixed aiming angles. For example, hardening of a flexible shroud would reduce stocking of different reflector cones where a different reflector cone would have to be stocked and installed for each such aiming angle. Instead of stocking multiple reflector cones, a flexible shroud can be hardened to form a custom reflector cone at whatever aiming angle is selected and implemented at the factory. In addition to reducing inventory, this also allows for more angles to be offered to the customer, instead of limiting the customer's selection to those angles for which reflector cones had already been manufactured. A hardenable, flexible shroud may be formed of a fabric that is impregnated with a material such as epoxy, resin, glue, concrete or the like that hardens under the right conditions (for example through exposure to ultraviolet radiation, heat, an appropriate catalyst, drying or simply the passage of time). The shroud may also be formed of a material with electrical adjustability between brittle and malleable states, such as an electrorheological fluid in a polymer medium.

Thus, in some embodiments, steps 305 through 315 of method 300 manufacture a light fixture. In some of these embodiments, step 320 couples a flexible shroud with the light fixture during manufacturing. In some of these embodiments, further steps 325 and 330 install and set up the light fixture. In still other embodiments, step 320 adds a flexible shroud to a light fixture that is provided separately. When a flexible shroud of a light fixture is formed of a material that can be hardened to hold its shape, step 335 can be performed in combination with any of the above-noted embodiments. That is, step 335 can be performed at the point of manufacturing, when light engine orientation can be set at the factory, or step 335 can be performed at any point during installation, such as after the light fixture is installed and the light engine is oriented as desired.

Figure 7A:
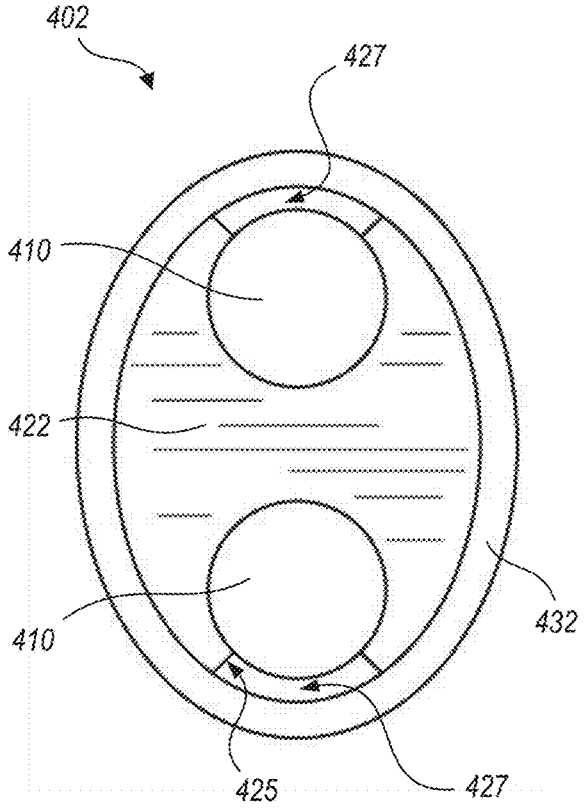
FIG. 7A is a bottom plan schematic view illustrating a light fixture that includes two light engines, a flexible shroud, and a trim piece, according to one or more embodiments.
Figure 7B:
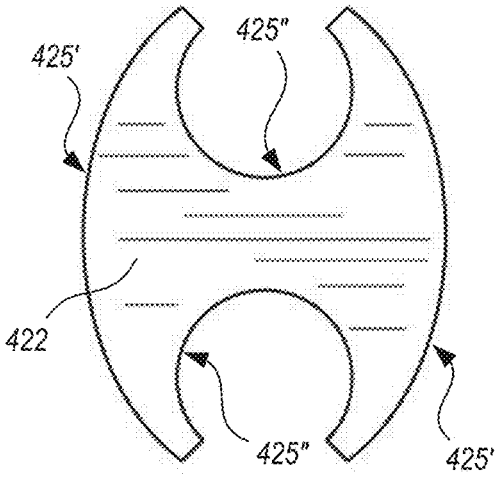
FIG. 7B is a schematic plan view of the shroud shown in FIG. 7A alone.

FIG. 7A is a bottom plan schematic view illustrating a light fixture 402 that includes two light engines 410, a flexible shroud 422, and a trim piece 432. FIG. 7B is a schematic plan view of shroud 422 alone. In FIG. 7A, trim piece 432 defines an inner perimeter of light fixture 402, with light engines 410 coupled so as to output light through the inner perimeter. Shroud 422 forms a single edge 425 that includes at least first and second edge portions 425' and 425", as shown. First edge portions 425' may couple with a housing of light fixture 402, or with trim piece 432, while edge portions 425" couple with light engines 410. FIG. 5A also illustrates gaps 427 between light engines 410 and trim piece 432, across which shroud 422 does not extend.

FIG. 7A thus illustrates that flexible shrouds need not cover all portions of a gap between light engines and an inner perimeter of a light fixture. Leaving gaps 427 uncovered by shroud 422 may be advantageous in certain assemblies where a light engine may adjust so as to cause extreme stretching of a flexible shroud, were one to be used. For example, if light engines 410 in light fixture 402 were to rotate up and down in the orientation of FIG. 7A, a flexible shroud stretched across narrow gap 427 might be stretched extremely, such that holding light engines 410 in position may become difficult, and/or a shroud formed in part of the flexible shroud could tear or break.

FIGS. 7A and 7B, together, illustrate that edge portions that couple with light engines and with a light fixture housing can simply be different portions of a common edge of a flexible shroud (compare FIGS. 3A, 3B, 3C where first edges bound an outer periphery of flexible membrane 224, and second edges bound inner peripheries of membrane 224 such that the first and second edges do not connect). Edge portions 425', 425" can (but do not have to) include thickness variations like thickness variations 226, 228 (FIGS. 3A, 3B, 3C). These thickness variations can be continuous along common edge 425 or limited to specific portions where reinforcement of common edge 425 is desired, such as where light engines 410 or a housing of light fixture 402 couples with shroud 422.

Figure 8A:
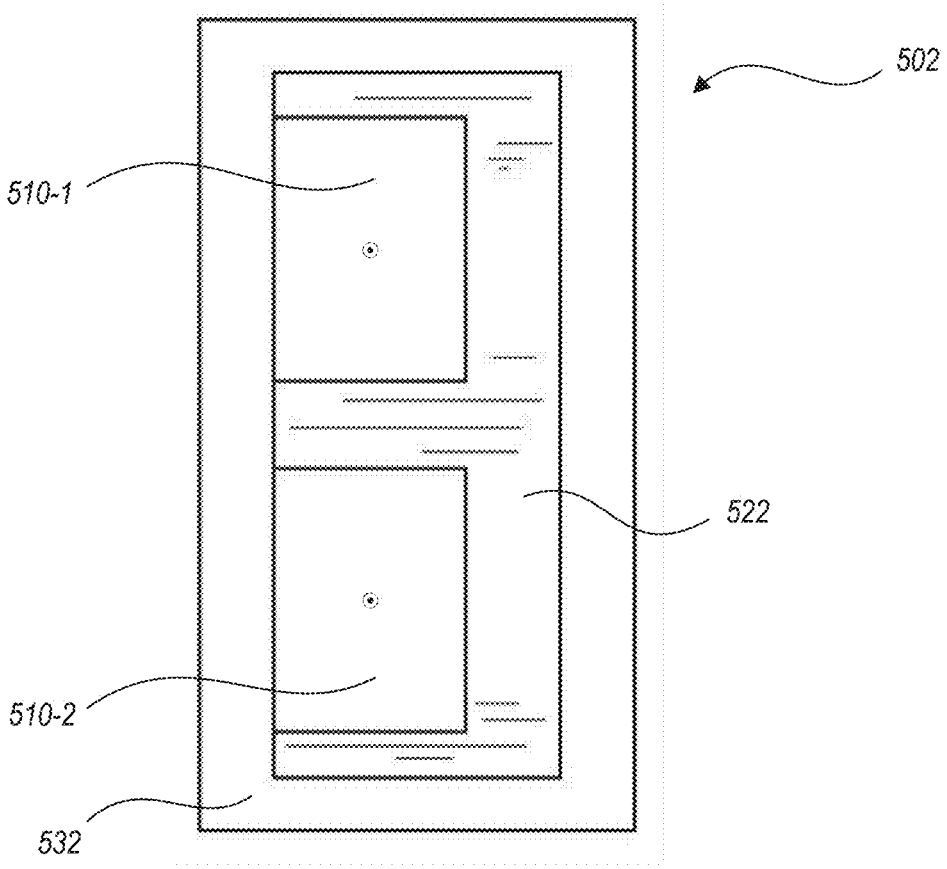
FIG. 8A is a schematic bottom plan view illustrating a light fixture that includes two light engines, a flexible shroud, and a trim piece, with both light engines oriented so as to emit light vertically, according to one or more embodiments.
Figure 8B:
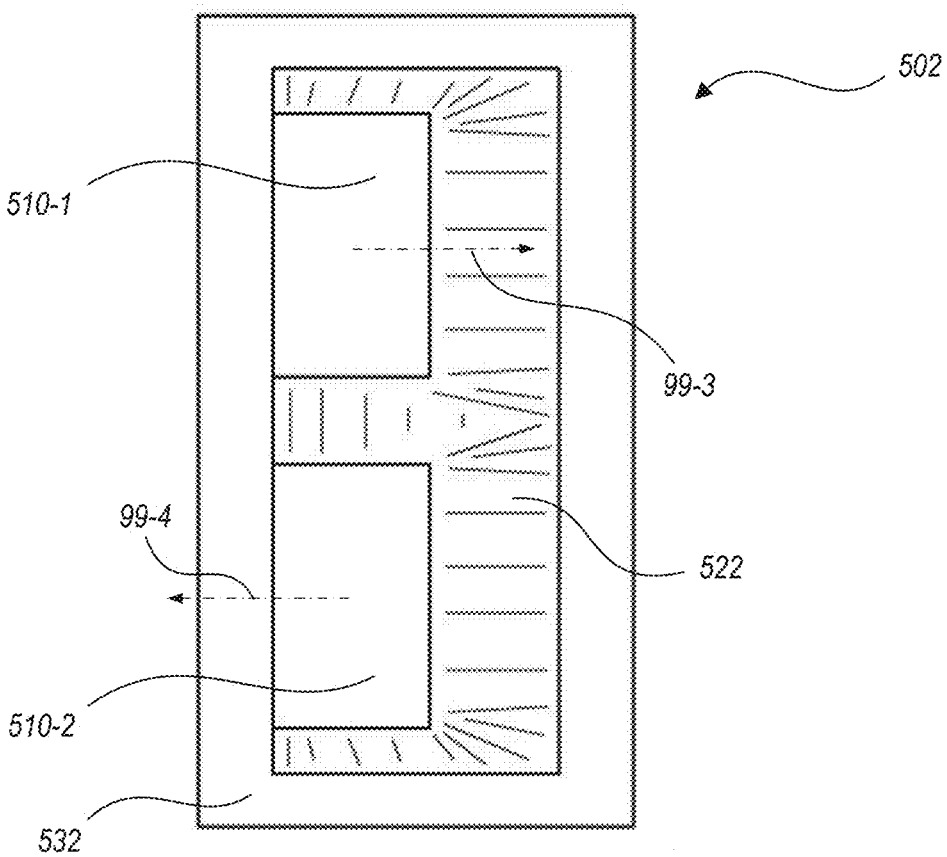
FIG. 8B is a schematic bottom plan view illustrating the light fixture of FIG. 8A, with both light engines oriented so as to emit light in different directions.

FIGS. 8A and 8B are schematic bottom plan views illustrating a light fixture 502 that includes two light engines 510, a flexible shroud 522, and a trim piece 532. In light fixture 502, light engines 510 couple via hinges (hidden behind trim piece 532) with a housing such that a gap between light engines and the housing does not exist at a location of the hinges. Thus, like shroud 422 (FIGS. 7A, 7B) shroud 522 forms only a single edge, between light engines 510 and an outer housing, which is not labeled in FIG. 8A). In FIG. 8A, both light engines 510 are oriented so as to emit light vertically (out of the plane of FIG. 8A). In FIG. 8B, an inner edge of light engine 510-1 is tilted upwardly, such that light emitted therefrom is aimed to the right, while an inner edge of light engine 510-2 is tilted downwardly, such that light emitted therefrom is aimed to the left, as shown by broken arrows 99-3, 99-4 respectively. FIGS. 8A and 8B thus illustrate that flexible shrouds herein need not wholly enclose or encircle a light engine to which they are attached, but may fill gaps of any shape between a light engine and a trim piece or outer housing.

Figure 9:
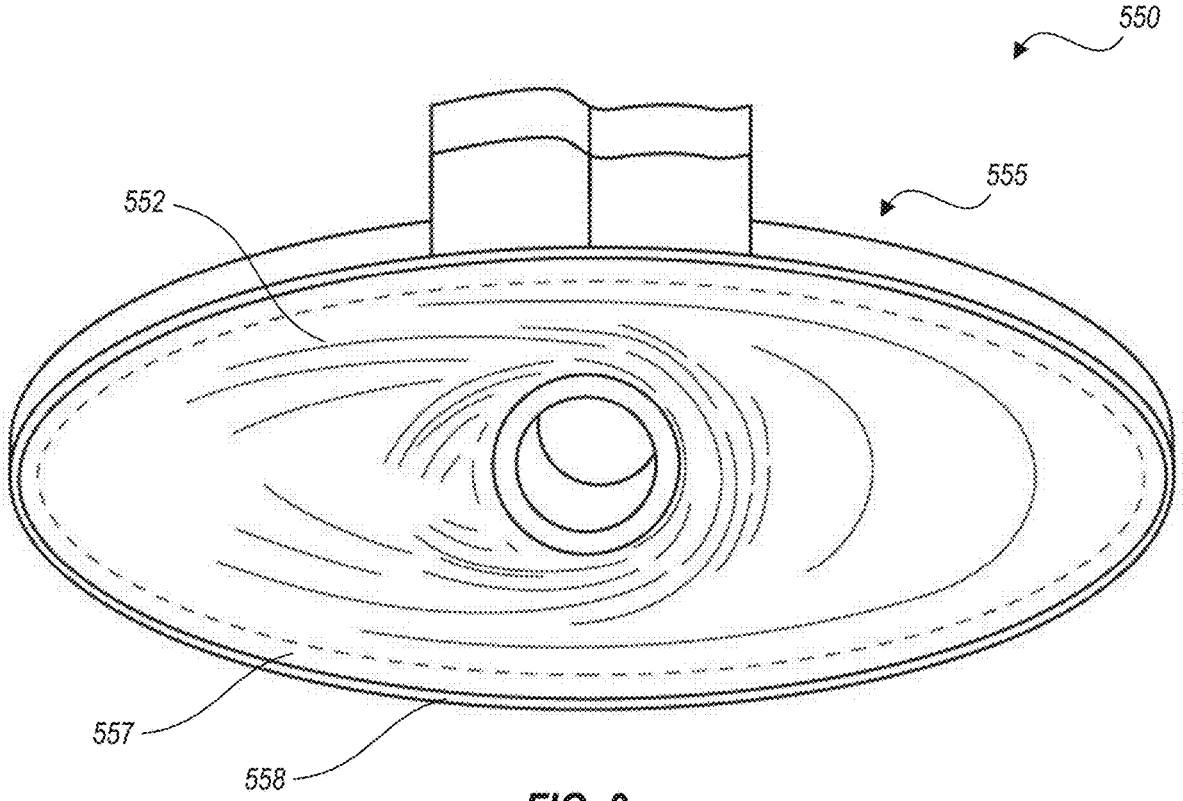
FIG. 9 is a non-limiting drawing of an embodiment of the invention.
Figure 10:
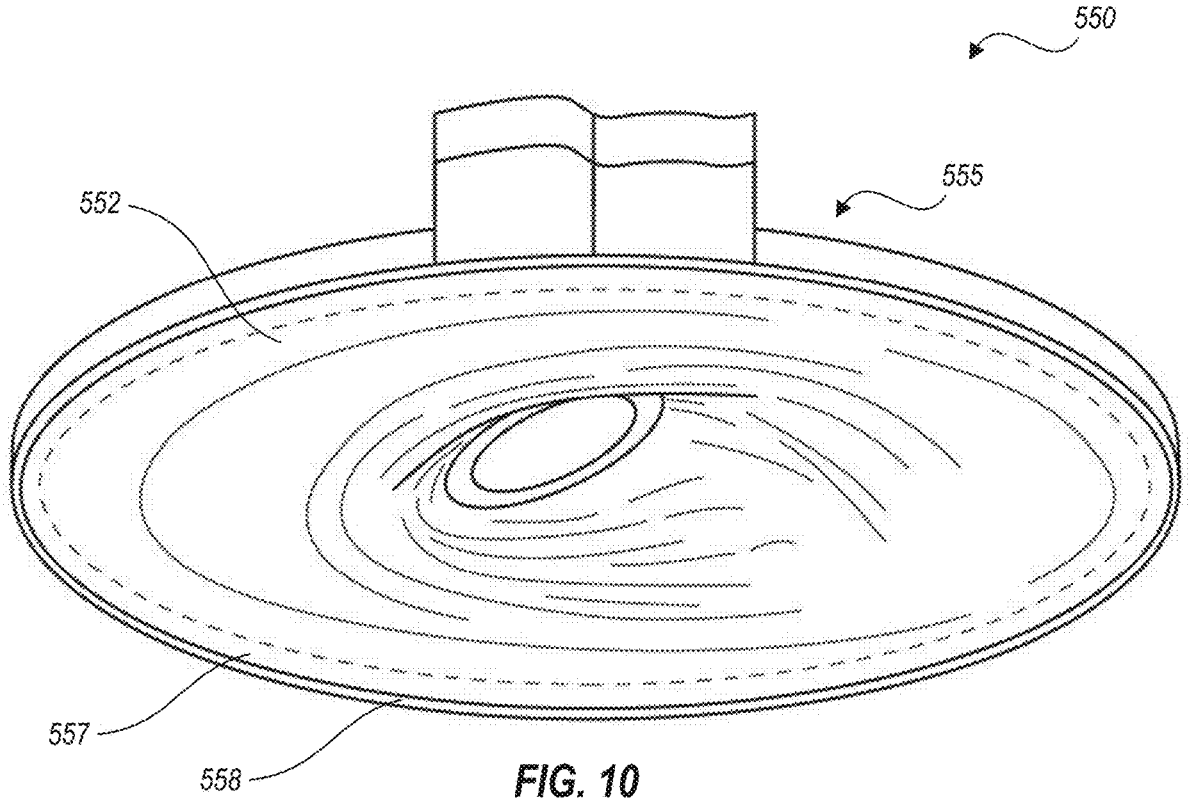
FIG. 10 is a non-limiting drawing of an embodiment of the invention.

FIGS. 9 and 10 are non-limiting drawings of a physical mockup 550 showing how a flexible shroud 552 reacts to certain applied forces. Flexible shroud 552 couples with a frame 555 that includes an inner hoop 557 (hidden behind flexible shroud 552 in the views of FIGS. 9 and 10) and an outer hoop 558. Outer hoop 558 clamps tightly about inner hoop 557 with flexible shroud 552 between the two, holding flexible shroud 552 in place much like an embroidery hoop holds a piece of fabric. Flexible shroud 552 also couples with an inner collar 560 that is provided in the place of a light source, for physical mockup purposes. In FIG. 9, a force pulls inner collar 560 upwardly and tilts it toward the viewer. Flexible shroud 552 stretches so that tension is minimized within flexible shroud 552. In this way, flexible shroud 552 assumes a smooth profile. without distracting features. In FIG. 10, a force pulls inner collar 560 upwardly and tilts it toward the right hand side of the drawing. Again, flexible shroud 552 stretches so that tension is minimized within flexible shroud 552, again assuming a smooth profile without distracting features.

Figure 11:
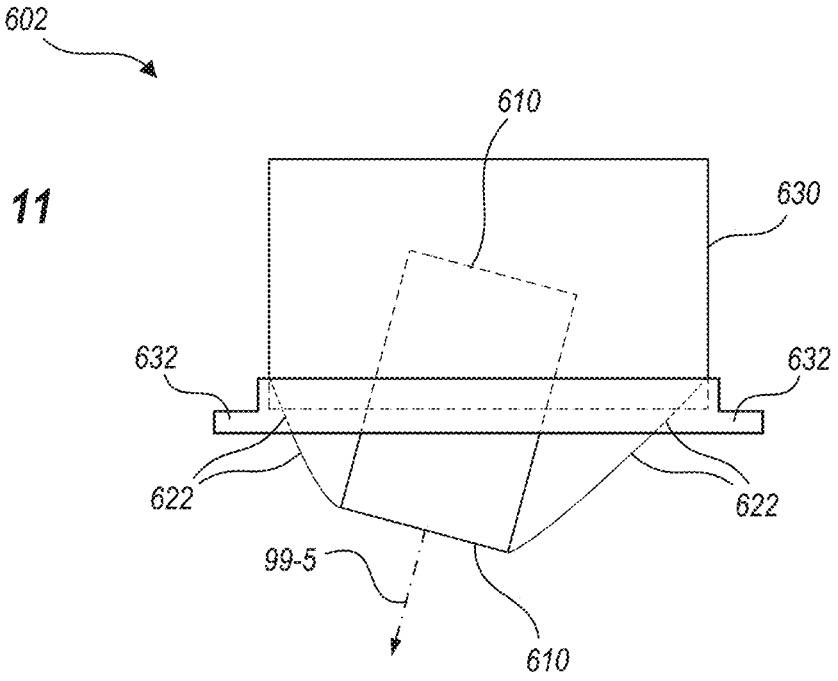
FIG. 11 is a schematic illustration of a light fixture with a light engine that is positioned so as to extend below an outer housing and an associated trim piece, according to one or more embodiments.
Figure 12:
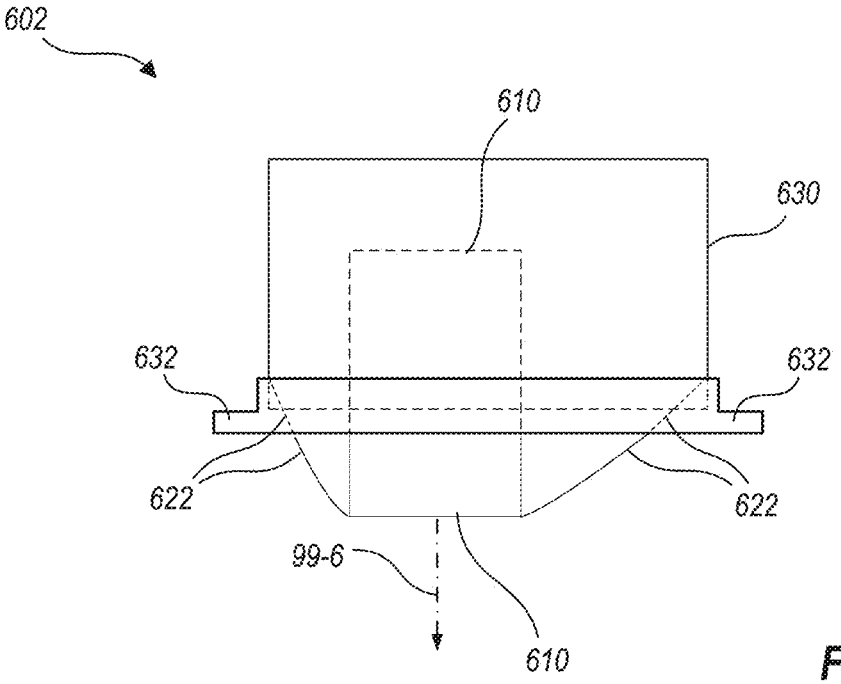
FIG. 12 schematic illustration of the light fixture of FIG. 11, with the light engine positioned differently, with a center of light emission that is vertical, yet not centered within the outer housing and/or the trim piece, according to one or more embodiments.

FIG. 11 is a schematic illustration of a light fixture 602 with a light engine 610 that is positioned so as to extend below an outer housing 630 and associated trim piece 632. Similar to light fixture 102 illustrated in FIG. 2C, flexible shroud 622 bridges a gap between trim piece 632 and light engine 610, but in FIG. 11, flexible shroud 622 extends below trim piece 632. This illustrates the idea that in various embodiments, light engines may be positioned not only at different angles but also at different heights, as desired for different aesthetic effects. FIG. 12 illustrates light fixture 602 with light engine 610 positioned still differently, with broken arrow 99-6 indicating a center of light emission that is vertical, yet is not centered within outer housing 630 and/or trim piece 622. Again, flexible shroud 622 bridges the gap between trim piece 632 and light engine 610, and flexible shroud 622 extends below trim piece 632.

FIGS. 13 through 17 schematically illustrate a wide variety of shapes that can be formed by light engines and light fixtures that include the light engines. These drawings, taken together, are disclosed to teach not only the combinations explicitly shown, but other combinations that they will suggest to one skilled in the art, some of which are discussed below. In particular, the illustrated shapes of light engines could be used for trim pieces, and vice versa.

Figure 13:
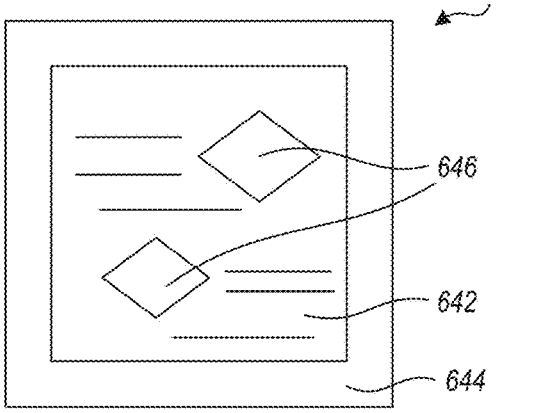
FIG. 13 schematically illustrates a light fixture with two light engines, a trim piece and a flexible shroud that covers a visual gap between the trim piece and the light engines, according to one or more embodiments.

FIG. 13 schematically illustrates a light fixture 640 with two light engines 646, a trim piece 644 and a flexible shroud 642 that covers a visual gap between trim piece 644 and light engines 646. Trim piece 644 is square and oversized compared to its outer size so that it may cover a housing that is square, or of some other shape and/or size. Similarly, whether the shape of oversized trim piece 644 matches a shape of a housing and/or a mounting surface opening, oversized trim piece 644 could cover any gaps between such housing and opening. Light engines 646 are diamond shaped. Considered together with the previous drawings, FIG. 13 demonstrates at least that trim pieces may be square, light engines may be diamond shaped, light engines need not be the same shape as a trim piece, and that an oversized trim piece may be used to conceal housings and/or openings of various shapes and/or sizes within a mounting surface. Conversely, a housing could be diamond shaped and light engines could be square.

Figure 14:
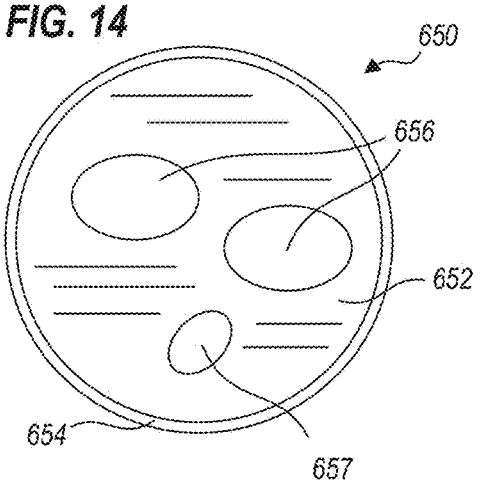
FIG. 14 schematically illustrates a light fixture with two light engines of a first shape, a light engine of a second shape, a trim piece and a flexible shroud that covers a visual gap between the trim piece and the light engines, according to one or more embodiments.

FIG. 14 schematically illustrates a light fixture 650 with two light engines 656, a third light engine 657, a trim piece 654 and a flexible shroud 652 that covers a visual gap between trim piece 654 and light engines 656 and 657. Trim piece 654 is circular and relatively narrow compared to its outer size. Light engines 656 have relatively large elliptical shapes oriented in one direction while light engine 657 has a relatively small elliptical shape oriented in a different direction, and light engines 656 and 657 are not arranged in a row or other arrangement. Considered together with the previous drawings, FIG. 14 demonstrates at least that trim pieces may be circular, light engines may be elliptical, light engines need not be of the same shape(s), size(s) and/or orientation(s) as one another, and may be arranged in any manner within a trim piece. Conversely, a housing could be elliptical and light engines could be circular.

Figure 15:
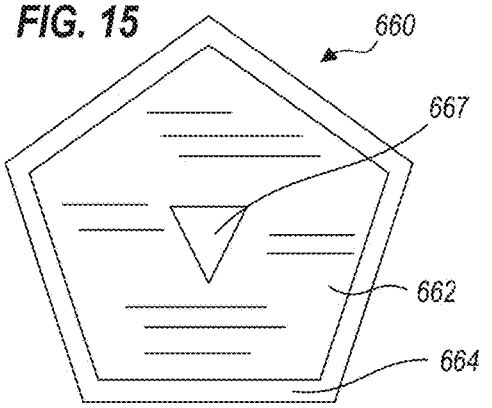
FIG. 15 schematically illustrates a light fixture with a light engine, a trim piece and a flexible shroud that covers a visual gap between the trim piece and the light engine, according to one or more embodiments.

FIG. 15 schematically illustrates a light fixture 660 with a light engine 667, a trim piece 664 and a flexible shroud 662 that covers a visual gap between trim piece 664 and light engine 667. Trim piece 664 is pentagonal. Light engine 667 has a triangular shape. Considered together with the previous drawings, FIG. 15 demonstrates at least that trim pieces may be pentagonal and that light engines may be triangular. Conversely, a housing could be triangular and light engines could be pentagonal.

Figure 16:
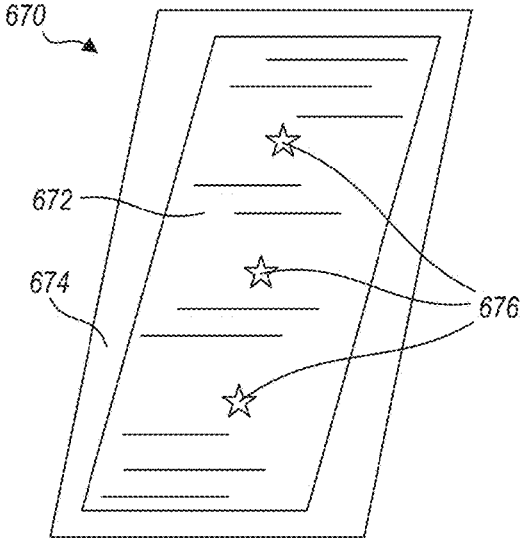
FIG. 16 schematically illustrates a light fixture with three light engines, a trim piece and a flexible shroud that covers a visual gap between the trim piece and the light engines, according to one or more embodiments.

FIG. 16 schematically illustrates a light fixture 670 with three light engines 676, a trim piece 674 and a flexible shroud 672 that covers a visual gap between trim piece 674 and light engines 676. Trim piece 674 is asymmetric, having an outer, trapezoidal shape and an inner trapezoidal opening that results in trim piece 674 having changes in width as it spans a periphery of light fixture 670. Light engines 676 have star shapes and are much smaller than an inner periphery of trim piece 674. Considered together with the previous drawings, FIG. 16 demonstrates at least that trim pieces may be asymmetrical and form changes in width as they span a periphery of a light fixture, that light engines may be star shaped and much smaller than an inner periphery of a trim piece. Conversely, a housing could be star shaped and light engines could be trapezoidal.

Figure 17:
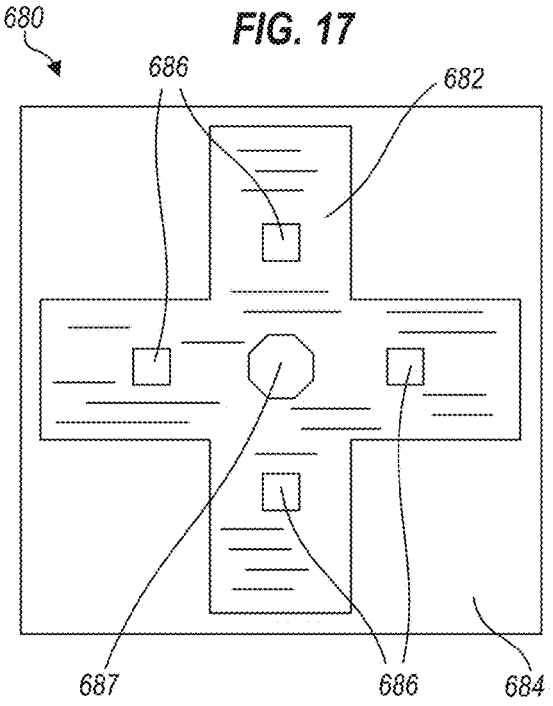
FIG. 17 schematically illustrates a light fixture with four light engines of a first shape, one octagonal light engine of a second shape, a trim piece and a flexible shroud that covers a visual gap between the trim piece and the light engines, according to one or more embodiments.

FIG. 17 schematically illustrates a light fixture 680 with four square light engines 686, one octagonal light engine 687, a trim piece 684 and a flexible shroud 682 that covers a visual gap between trim piece 684 and light engines 686. An outer periphery of trim piece 684 is square, and an inner periphery of trim piece 684 is cross shaped. Thus, large areas appearing at certain locations between the outer and inner peripheries of trim piece 684 could conceal light fixture housings and/or mounting surface openings of various sizes and shapes smaller than the outer periphery of trim piece 684. Considered together with the previous drawings, FIG. 17 demonstrates at least that trim pieces may form inner and outer peripheries having different shapes, that light engines may be square or octagonal shaped, and that light engines of differing sizes and/or shapes may be present within the same light fixture. Conversely, a housing could be octagonal or square shaped, and light engines could be cross shaped.

Although some embodiments are illustrated herein with all light engines of a given fixture arranged in a line or other arrangement, they need not be. For example, housings may be configured in other shapes such as arrays, staggered rows, circles, ellipses, crosses, or other arrangements. Upon reading and comprehending the present disclosure, one of ordinary skill in the art will readily conceive many equivalents, extensions, and alternatives.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described, are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A light fixture, comprising:

a light source within a light engine;

an outer housing having an inner perimeter, wherein the light engine is positioned within the outer housing so as to define a gap between the light engine and the inner perimeter of the outer housing; and a flexible shroud that forms at least first and second edge portions, wherein:

the light engine couples with the flexible shroud along at least the first edge portion of the flexible shroud, and the inner perimeter of the outer housing couples with the flexible shroud along the second edge portion of the flexible shroud, so that the flexible shroud extends across at least a portion of the gap.

2. The light fixture of claim 1, wherein the flexible shroud is in tension across at least part of the gap.

3. The light fixture of claim 2, wherein:

the flexible shroud couples movably with at one of the light engine and the inner perimeter, and couples fixedly with the other of the light engine and the inner perimeter, such that when the light engine moves within the outer housing, the flexible shroud moves with respect to the one of the light engine and the inner perimeter, to minimize the tension.

4. The light fixture of claim 1, wherein the flexible shroud comprises silicone.

5. The light fixture of claim 1, wherein the flexible shroud comprises a colored material.

6. The light fixture of claim 5, wherein the colored material comprises one or more of a phosphor, a pigment, a dye and a dichroic material.

7. The light fixture of claim 1, wherein the flexible shroud comprises a thickness of less than three millimeters at any point that is at least three millimeters from the first edge portion and the second edge portion of the flexible shroud.

8. The light fixture of claim 1, wherein the flexible shroud comprises at least one thickness variation, and at least one of the light engine and the inner perimeter couples with the flexible shroud by at least partially enclosing the thickness variation.

9. The light fixture of claim 1, wherein at least a portion of the flexible shroud has a visually flat appearance.

10. The light fixture of claim 1, wherein at least a portion of the flexible shroud is opaque.

11. The light fixture of claim 1, wherein at least a portion of the flexible shroud is reflective.

12. The light fixture of claim 1, wherein at least a portion of the flexible shroud is translucent.

13. The light fixture of claim 12, the light source being a first light source, the light fixture further comprising a second light source that illuminates the flexible shroud from within the outer housing, such that the flexible shroud glows.

14. The light fixture of claim 1, wherein the flexible shroud forms an aperture, the first edge portion being an inner periphery of the aperture, the second edge portion being an outer periphery of the flexible shroud.

15. The light fixture of claim 14, the light engine being a first light engine;

the light fixture further comprising:

one or more additional light engines, each having an additional light source therein;

and wherein:

the flexible shroud forms a number of apertures corresponding in number to the first light engine and the additional light engines, such that each aperture defines a respective inner periphery of the flexible shroud; and each of the light engines couples with the flexible shroud along at least a portion of a respective one of the inner peripheries.

16. A shroud for use in a light fixture, comprising:

a flexible shroud that defines one or more edges; and one or more coupling features along the one or more edges, wherein the flexible shroud forms a thickness variation at least one of the coupling features, to engage a corresponding coupling feature of a light fixture.

17. The shroud of claim 16, wherein the flexible shroud is planar when no stress is applied to the shroud.

18. The shroud of claim 16, wherein the flexible shroud is downwardly concave when no stress is applied to the shroud.

19. The shroud of claim 16, wherein the flexible shroud comprises silicone.

20. A method of visually de-emphasizing a gap between a light engine and a light fixture housing, comprising:

providing a light fixture housing that has an output aperture bounded by an inner perimeter;

providing a light source within a light engine;

coupling the light engine within the light fixture housing, wherein:

the light engine is coupled and disposed within the light fixture housing so as to leave a gap between the light engine and the inner perimeter of the light fixture housing, and the light engine is configured to emit light through the output aperture; and coupling a flexible shroud across at least a portion of the gap between the light engine and the inner perimeter of the housing, wherein the flexible shroud obscures a substantial portion of the gap.

* * * * *